US010780481B2

(12) United States Patent
Tang et al.

(10) Patent No.: US 10,780,481 B2
(45) **Date of Patent: *Sep. 22, 2020**

(54) BENDING AND MOLDING MECHANISM

(71) Applicants: JIANGSU UNIVERSITY OF SCIENCE AND TECHNOLOGY INDUSTRIAL TECHNOLOGY RESEARCH INSTITUTE OF ZHANGJIAGANG, Jiangsu (CN); JIANGSU UNIVERSITY OF SCIENCE AND TECHNOLOGY, Jiangsu (CN)

(72) Inventors: Wenxian Tang, Jiangsu (CN); Jian Zhang, Jiangsu (CN); Hongcai Lin, Jiangsu (CN); Yang Zhang, Jiangsu (CN); Shijie Su, Jiangsu (CN); Shifeng Hang, Jiangsu (CN); Hong Zhuang, Jiangsu (CN)

(73) Assignees: JIANGSU UNIVERSITY OF SCIENCE AND TECHNOLOGY INDUSTRIAL TECHNOLOGY RESEARCH INSTITUTE OF ZHANGJIAGANG, Jiangsu (CN); JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 281 days.

This patent is subject to a terminal disclaimer.

(21) Appl. No.: 15/532,888

(22) PCT Filed: Feb. 22, 2016

(86) PCT No.: PCT/CN2016/074208

§ 371 (c)(1),
(2) Date: Jun. 2, 2017

(87) PCT Pub. No.: WO2016/165478

PCT Pub. Date: Oct. 20, 2016

(65) Prior Publication Data

US 2018/0036781 A1 Feb. 8, 2018

(30) Foreign Application Priority Data

Apr. 13, 2015 (CN) ..... 2015 1 0170644

(51) Int. Cl.
*B21D 7/08* (2006.01)
*B21F 1/00* (2006.01)
(Continued)

(52) U.S. Cl.
CPC ..... *B21D 7/085* (2013.01); *B21D 9/01* (2013.01); *B21D 9/12* (2013.01); *B21D 43/003* (2013.01);
(Continued)

(58) Field of Classification Search
CPC ..... B21D 7/02; B21D 7/022; B21D 7/024; B21D 7/03; B21D 7/04; B21D 7/08;
(Continued)

(56) References Cited

U.S. PATENT DOCUMENTS 4,471,819 A 9/1984 Nihashi
6,128,811 A * 10/2000 Panzer ..... B21D 7/022 24/20 R

FOREIGN PATENT DOCUMENTS

CN 201346606 Y 11/2009
CN 201618768 U 11/2010
(Continued)

*Primary Examiner* — Teresa M Ekiert
*Assistant Examiner* — Sarkis A Aktavoukian
(74) *Attorney, Agent, or Firm* — Oliff PLC

(57) ABSTRACT

A bending and molding mechanism includes two bases, wherein the bases are provided with a transverse sliding rail, two transverse sliding bases are disposed on the transverse sliding rail in a sliding manner, the base is provided with a
(Continued)

transverse driving device driving the transverse sliding bases, the base is provided with a central clamping device, the transverse sliding bases are provided with a longitudinal sliding rail, the longitudinal sliding rail is provided with a longitudinal sliding base, the transverse sliding bases are provided with a longitudinal driving device driving the longitudinal sliding base to slide, the longitudinal sliding base is provided with a bending and molding device, one side of the transverse sliding base at the left side is provided with a left clamping device, and one side of the transverse sliding base at the right side is provided with a right clamping device.

2 Claims, 2 Drawing Sheets

(51) Int. Cl.

| | |
|---|---|
| ***B21D 9/12*** | (2006.01) |
| ***B21D 9/01*** | (2006.01) |
| ***B21D 43/00*** | (2006.01) |
| ***B21F 1/02*** | (2006.01) |

(52) U.S. Cl.
CPC ..... *B21D 43/006* (2013.01); *B21F 1/00* (2013.01); *B21F 1/023* (2013.01)

(58) Field of Classification Search
CPC ..... B21D 7/085; B21D 7/16; B21D 11/22; B21D 37/04; B21D 37/14; B21D 43/003; B21F 1/00; B21F 1/006; B21F 1/008
See application file for complete search history.

(56) References Cited

FOREIGN PATENT DOCUMENTS

| | | | | |
|---|---|---|---|---|
| CN | 202021247 | U | | 11/2011 |
| CN | 202087732 | U | | 12/2011 |
| CN | 102366802 | A | | 3/2012 |
| CN | 104801629 | A | | 7/2015 |
| CN | 204638972 | U | | 9/2015 |
| CN | 206065275 | U | * | 5/2017 |
| JP | S611434 | A | | 1/1986 |
| JP | 2003311335 | A | | 11/2003 |
| TW | 469186 | B | | 12/2001 |

* cited by examiner

BENDING AND MOLDING MECHANISM

BACKGROUND

Technical Field

The present invention relates to a bending machining device for tubular products and wires, in particular to a bending and molding mechanism.

Related Art

At present, the machinery industry develops rapidly, requirements on the numbers and standards of various bent and molded tubular products and wires are increased continuously, and all such requirements promote deep and meticulous innovation and research and development on a bending machining process and machining device of the tubular products and wires.

The bending and molding device belongs to a part of the bending machine for the tubular products and wires, and can bend the tubular products and wires fed from the last procedure into a required shape through a bending head part according to machining requirements.

Most of the current dual-head bending mechanisms can perform symmetric bending and cannot perform asymmetric machining, and cannot meet market requirements; meanwhile, due to the maintenance of a power part, the work amount of mounting and dismounting is large, efficient replacement and maintenance are hard to realize, and a low working efficiency is resulted.

For example, the patent with a patent number 201020147236.5 discloses a pipe bending machine, but a bending device thereof can only realize symmetric bending and cannot provide asymmetric machining of the tubular products and wires.

For example, the patent with a patent number 201020595165.5 discloses a pipe bending machine, but a power part of a bending device thereof is relatively complex to mount and detach, and cannot easily realize efficient maintenance, which leads to a low working efficiency.

SUMMARY

The invention solves the technical problem about providing a dual-head bending and molding mechanism which can bend both sides of a tubular product or wire from different bending angles and different bending radii.

In order to solve the technical problem, the technical solution adopted by the present invention is: a bending and molding mechanism, comprising a base, wherein the base is provide with a transverse sliding rail, two transverse sliding bases are disposed on the transverse sliding rail in a sliding manner, the base is provided with a transverse driving device driving the transverse sliding bases, the base is provided with a central clamping device which can clamp the wire and can rotate around a central axis of the wire between the two transverse sliding bases, the transverse sliding bases are provided with a longitudinal sliding rail, the longitudinal sliding rail is provided with a longitudinal sliding base, the transverse sliding bases are provided with a longitudinal driving device driving the longitudinal sliding base to slide, the longitudinal sliding base is provided with a bending and molding device, one side, close to the central clamping device, of the transverse sliding base at the left side is provided with a left clamping device capable of movably extending to clamp the wire, one side, close to the central clamping device, of the transverse sliding base at the right side is provided with a right clamping device capable of movably extending to clamp the wire, the bending and molding mechanism comprises a hollow mounting base rotatably disposed on the longitudinal sliding base, a hollow shaft is rotatably disposed in the mounting base in a penetrating manner, a mandrel is rotatably disposed in the hollow shaft in a penetrating manner, a longitudinal sliding base extends out of one ends of the hollow shaft and the mandrel, the hollow shaft is provided with a moving bending head at this end, the end part of the moving bending head is cylindrical and its periphery is provided with a circle of groove matched with the wire to be matched, the mandrel is detachably provided with a fixed bending die at this end, the fixed bending die is provided with four cylindrical fixed bending modules of which the connecting lines are in a rectangle, an interval between two rows of fixed bending modules is matched with a diameter of the wire to be bent, the other end of the mandrel is connected to a fixed die motor disposed on the longitudinal sliding base, a driven synchronous belt wheel sleeves the periphery of the other end of the hollow shaft, the longitudinal sliding base is provided with a moving die motor, an output shaft of the moving die motor is provided with a driving synchronous belt wheel matched with the driven synchronous belt wheel, and a synchronous belt sleeves the driven synchronous belt wheel and the driving synchronous belt wheel.

As a preferable solution, the left gripping device comprises a left base disposed on the longitudinal sliding base at the left side, a certain included angle exists between the upper surface of the longitudinal sliding base and the left base, the upper surface of the left base is provided with a left sliding rail, the left sliding rail is provided with a left sliding base, the left sliding base is provided with a left mounting base, the left mounting base is provide with a clamping component driven by a clamping cylinder to open or clamp, and the left base is provided with a sliding cylinder driving the left sliding base to drive the clamping component to approach to the wire from bottom to top; the right gripping device comprises a right base disposed on the longitudinal sliding base at the right side, a certain included angle exists between the upper surface of the longitudinal sliding base and the right base, the right base is provided with a right sliding rail, the right sliding rail is provided with a right sliding base, the right sliding base is provided with a right mounting base, the right mounting base is provide with a clamping component driven by a clamping cylinder to open or clamp, and the right base is provided with a sliding cylinder driving the right sliding base to drive the clamping component to approach to the wire from top to bottom.

As a preferable solution, the longitudinal driving device comprises a longitudinal driving motor disposed on the transverse sliding base, the longitudinal sliding base is provided with a longitudinal lead screw, and the longitudinal driving motor is connected to the end part of the longitudinal lead screw by a coupler.

As a preferable solution, the transverse driving device comprises a rack disposed on the base, the transverse sliding base is provided with a transverse driving motor, and an output shaft of the transverse driving motor downwards penetrates out of the transverse sliding base and is connected to a gear matched with the rack.

The present invention has the beneficial effects: according to the device, the central clamping device is adopted to clamp the wire, and a dual-head single bending manner is adopted, the two ends can meet the requirements of different bending angles, bending radii and bending lengths, the asymmetric bending of the wire can be realized, and the working flexibility of the bending machine is improved.

Since the clamping device is adopted beside the bending and molding device and plays a role of locating the wire, the wire in the position close to the bending and molding device is prevented from generating unnecessary bending deformation, such that the product quality is ensured.

Since the clamping component of the clamping device is driven by the cylinder, such that in the bending process, the wire is stably bent, the vibration generated during bending is reduced, and the working reliability of the whole device is improved.

Since the hollow shaft is provided with the moving bending head, the mandrel is detachably provided with the fixed bending die, and the central shaft and the mandrel are respectively driven by an external power connecting device, the whole structure is simple and convenient to mount.

Since the clamping component of the left clamping device approaches to the wire from bottom to top, and the clamping component of the right clamping device approaches to a sliding cylinder of the wire from top to bottom, the bending and molding device is disposed in a position, close to the central clamping device as much as possible, on the longitudinal sliding base, such that the left and right clamping devices generate no interference when the left and right transverse sliding bases approach and are returned, such that the minimal length of a middle bending section can be reduced by a width value of one clamping device, such that the bending of a shorter distance of the middle of the tubular product can be realized, and the device is suitable for product machining of a wider range.

BRIEF DESCRIPTION OF THE DRAWINGS

In FIGS. 1-5, 1 base, 2 transverse sliding rail, 3 transverse sliding base, 4 transverse driving device, 41 transverse driving motor, 42 gear, 5 central clamping device, 6 longitudinal sliding rail, 7 longitudinal sliding base, 8 longitudinal driving device, 81 longitudinal driving motor, 82 longitudinal lead screw, 83 coupler.

9 bending and molding device, 91 mounting base, 92 hollow shaft, 93 mandrel, 94 moving bending head, 95 fixed bending die, 96 fixed die motor, 97 driven synchronous belt wheel, 98 moving die motor, 99 active synchronous belt wheel, 10 left clamping device, 101 left base, 102 left sliding rail, 103 left sliding base, 104 left mounting base, 105 clamping component, 106 sliding cylinder, 11 right clamping device, 111 right base, 112 right sliding rail, 113 right sliding base, 114 right mounting base, 115 clamping component, 116 sliding cylinder.

DETAILED DESCRIPTION

The specific implementing solutions of the present invention are described in detail in combination with the drawings.

Figure 1:
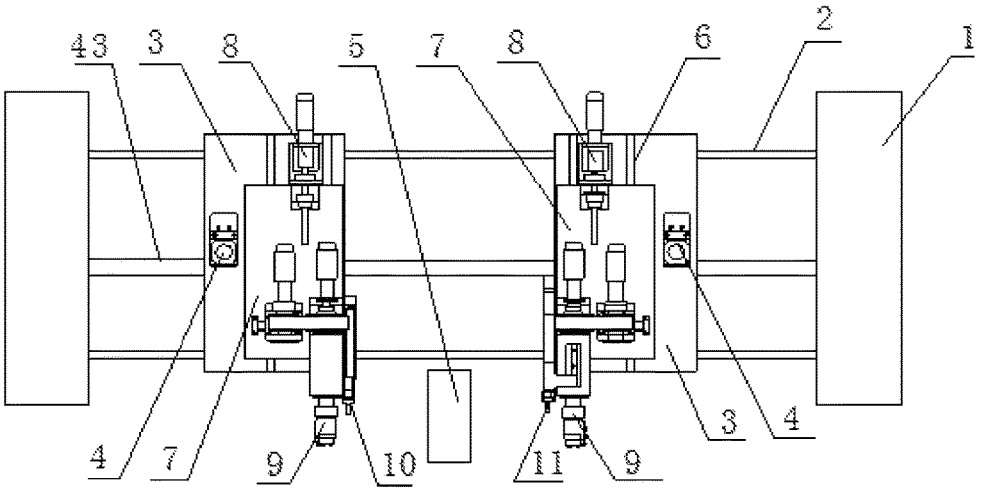
FIG. 1 is a structural schematic diagram of the present invention.
Figure 2:
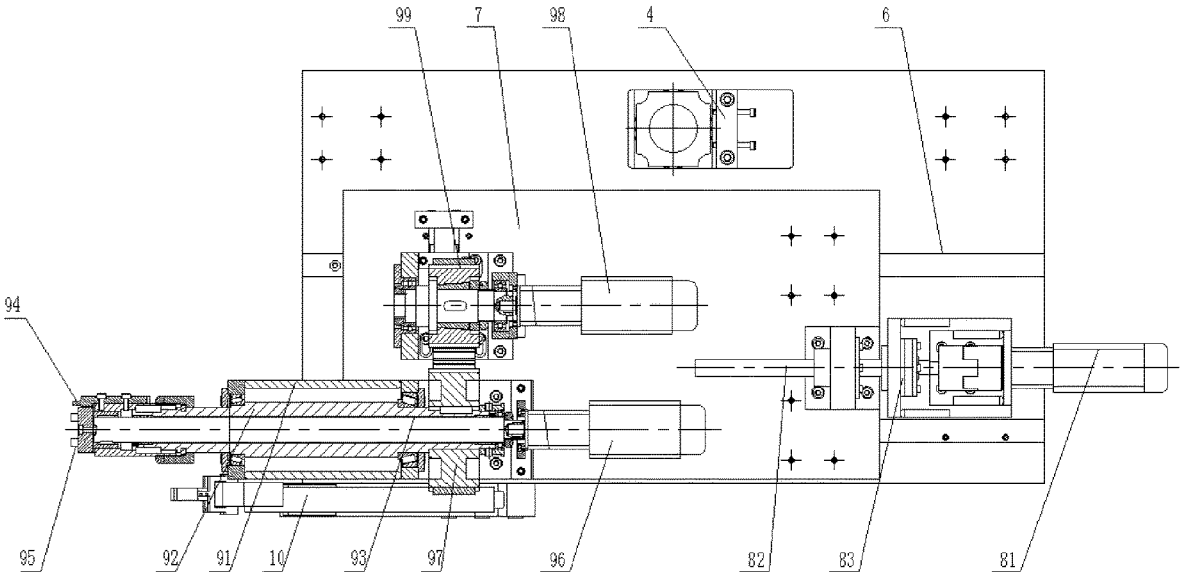
FIG. 2 is a top structural schematic view of a transverse sliding base and parts thereon at the left side in the present invention.
Figure 3:
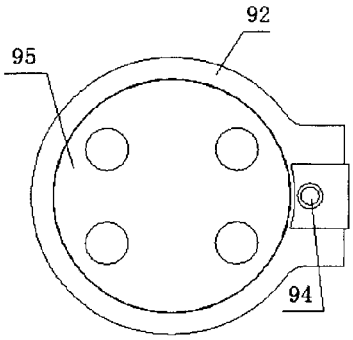
FIG. 3 is a structural schematic view of an end surface of a bending and molding device at the right side in the present invention.
Figure 4:
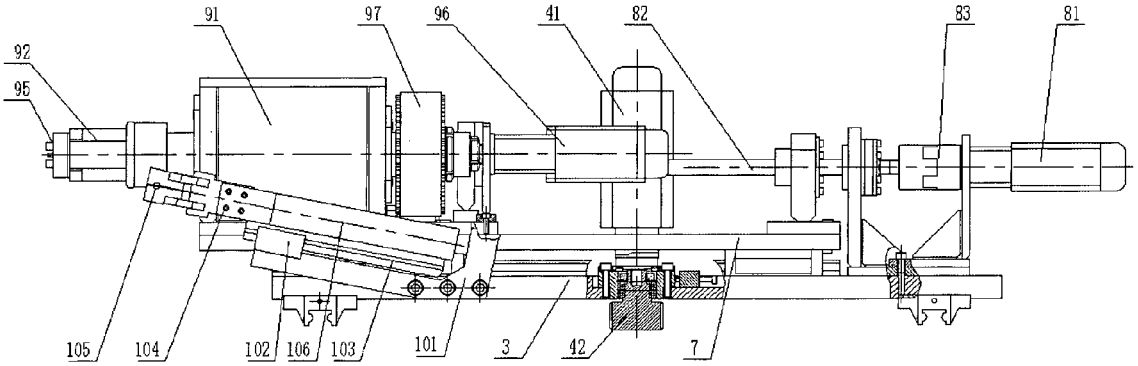
FIG. 4 is a right structural schematic view of the transverse sliding base and the parts thereon at the left side in the present invention.
Figure 5:
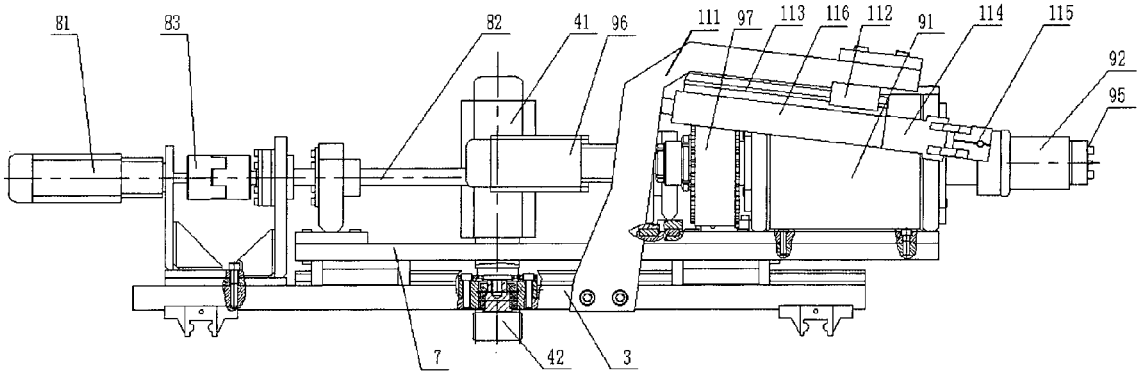
FIG. 5 is a left structural schematic view of a transverse sliding base and parts thereon at the right side in the present invention.

As shown in FIGS. 1-5, a bending and molding mechanism comprises a base 1, wherein the base 1 is provide with a transverse sliding rail 2, two transverse sliding bases 3 are disposed on the transverse sliding rail 2 in a sliding manner, and the base 1 is provided with a transverse driving device 4 driving the transverse sliding bases 3. The transverse driving device 4 comprises a rack 43 disposed on the base 1, the transverse sliding base 3 is provided with a transverse driving motor 41, and an output shaft of the transverse driving motor 41 downwards penetrates out of the transverse sliding base 3 and is connected to a gear 42 matched with the rack 43. The base 1 is provided with a central clamping device 5 which can clamp the wire and can rotate around a central axis of the wire between the two transverse sliding bases 3.

The transverse sliding bases 3 are provided with a longitudinal sliding rail 6, the longitudinal sliding rail 6 is provided with a longitudinal sliding base 7, and the transverse sliding base 3 is provided with a longitudinal driving device 8 driving the longitudinal sliding base 7 to slide. The longitudinal driving device 8 comprises a longitudinal driving motor 81 disposed on the transverse sliding base 3, the longitudinal sliding base 7 is provided with a longitudinal lead screw 82, and the longitudinal driving motor 81 is connected to an end part of a longitudinal lead screw 82 by a computer 83. The longitudinal sliding base 7 is provided with a bending and molding device 9.

The bending and molding device 9 comprises a hollow mounting base 91 rotatably disposed on the longitudinal sliding base 7, a hollow shaft 92 is rotatably disposed in the mounting base 91 in a penetrating manner, a mandrel 93 is rotatably disposed in the hollow shaft 92 in a penetrating manner, a longitudinal sliding base extends out of one ends of the hollow shaft 92 and the mandrel 93, the hollow shaft 92 is provided with a moving bending head 94 at this end, the end part of the moving bending head 94 is cylindrical and its periphery is provided with a circle of groove matched with the wire to be matched, the mandrel 93 is detachably provided with a fixed bending die 95 at this end, the fixed bending die 95 is provided with four cylindrical fixed bending modules of which the connecting lines are in a rectangle, an interval between two rows of fixed bending modules is matched with a diameter of the wire to be bent, the other end of the mandrel 93 is connected to a fixed die motor 96 disposed on the longitudinal sliding base, a driven synchronous belt wheel 97 sleeves the periphery of the other end of the hollow shaft 92, the longitudinal sliding base is provided with a moving die motor 98, an output shaft of the moving die motor 98 is provided with a driving synchronous belt wheel matched with the driven synchronous belt wheel 97, and a synchronous belt sleeves the driven synchronous belt wheel 97 and the driving synchronous belt wheel 99.

One side, close to the central clamping device 5, of the transverse sliding base 3 at the left side is provided with a left clamping device 10 capable of movably extending to clamp the wire. The clamping device comprises a left base 101 disposed on the longitudinal sliding base 7 at the left side, a certain included angle exists between the upper surface of the longitudinal sliding base and the left base, the upper surface of the left base 101 is provided with a left sliding rail 102, the left sliding rail 102 is provided with a left sliding base 103, the left sliding base 103 is provided with a left mounting base 104, the left mounting base 104 is provide with a clamping component 105 driven by a clamping cylinder to open or clamp, and the left base 101 is provided with a sliding cylinder 106 driving the left sliding base 103 to drive the clamping component 105 to approach to the wire from bottom to top.

One side, close to the central clamping device 5, of the transverse sliding base 3 at the right side is provided with a right clamping device 11 capable of movably extending to clamp the wire. The right gripping device comprises a right base 111 disposed on the longitudinal sliding base 7 at the right side, a certain included angle exists between the upper surface of the longitudinal sliding base and the right base, the right base 111 is provided with a right sliding rail 112, the right sliding rail 112 is provided with a right sliding base 113, the right sliding base 113 is provided with a right mounting base 114, the right mounting base 114 is provide with a clamping component 115 driven by a clamping cylinder to open or clamp, and the right base 111 is provided with a sliding cylinder 116 driving the right sliding base 113 to drive the clamping component 115 to approach to the wire from top to bottom.

When the last working station places the well prepared wire on the central clamping device 5, the left and right transverse sliding bases 3 move at the same time and begin to bend the wire from both ends to the middle section by section.

The moving process of the transverse sliding base 3 at the left side is described in detail, when the wire is placed on the central clamping device 5, a signal receiver on the central clamping device 5 sends a signal to the controller, the controller drives the longitudinal driving motor 81 to rotate so as to drive the longitudinal lead screw 82 to rotate, and the longitudinal sliding base 7 is pushed to extend forwards to reach to a designated bending position. Meanwhile, the clamping component 105 is pushed by the sliding cylinder 106 to extend out and reach a corresponding position to clamp the wire. At this point, the transverse driving motor 41 rotates to drive the gear 42 and rack mechanism to move, and the transverse sliding bases 3 are transversely moved to the designated bending position. Bending is started, the moving die motor 98 drives the hollow shaft 92 to rotate, and the moving bending head 94 at the front end of the hollow shaft 92 rotates therewith to bend the wire.

When space bending is required, only the central clamping device 5 is required to rotate the wire by a corresponding angle, then the transverse driving motor 41 drives the transverse sliding base 3 to reach a corresponding bending section position, and further the wire is bent.

When a bending radius or a angle bending shape needs to be corrected or the raw material of the used wire is bent per se, and certain section, a certain angle is formed between which and the central clamping device 5, on the wire needs to be bent, the longitudinal driving motor 81 rotates reversely, the longitudinal lead screw 82 rotates therewith and drives the longitudinal sliding base 7 to return, at this point, the fixed die motor 96 drives the mandrel 93 to rotate for a required angle, the fixed bending die 95 at the front end of the mandrel 93 rotates to a corresponding angle therewith, then the longitudinal driving motor 91 pushes the longitudinal slide base 7 to reach a bending position to locate a section to be bent between the two rows of fixed bending dies, and then the wire is bent to change the bending radius or the angle bending shape.

After the required bending action is finished, the clamping component 105 is loosened and returned, meanwhile, the longitudinal driving motor 81 rotates backwards, the longitudinal lead screw 82 rotates and drives the longitudinal sliding base 7 to return back to the initial position, and then the transverse driving motor 41 drives the transverse sliding base 3 to retreat to the initial position.

If the diameter of the wire to be bent changes, then the fixed bending die 95 is directly replaced.

The above embodiments merely exemplarily illustrate the principle and effects of the present invention and are merely partially applied embodiments instead of limiting the present invention; it should be pointed out that those skilled in the art can make some transformations and improvements without departing from creative thought of the present invention, and those transformations and improvements all belong to a protective scope of the present invention.

What is claimed is:

1. a bending and molding mechanism comprising:

a stationary base provided with a transverse sliding rail;

two transverse sliding bases disposed on the transverse sliding rail in a sliding manner, wherein each of the transverse sliding bases is provided with a transverse driving device driving the respective transverse sliding base, each of the two transverse sliding bases being provided with a longitudinal sliding rail, each longitudinal sliding rail being provided with a longitudinal sliding base, and each of the two transverse sliding bases is provided with a longitudinal driving device driving the respective longitudinal sliding base to cause the longitudinal sliding base to slide;

a central clamping device configured to clamp a wire and rotate around a central axis of the wire between the two transverse sliding bases;

a hollow mounting base rotatably disposed on each of the longitudinal sliding bases;

a hollow shaft rotatably penetrating each hollow mounting base; and a mandrel rotatably penetrating the hollow shaft of each hollow mounting base, the respective hollow shaft at a first end extending outward from one end of each longitudinal sliding base, wherein:

each longitudinal sliding base is provided with a bending and molding device, a left clamping device is configured to movably extend to clamp the wire, the left clamping device being located on the transverse sliding base that is located at a left side of the central clamping device, the left clamping device being provided at a first side of the transverse sliding base located at the left side of the central clamping device, wherein the first side of the transverse sliding base is located towards the central clamping device, a right clamping device is configured to movably extend the clamp the wire, the right clamping device being provided on the transverse sliding base that is located at a right side of the central clamping device, the right clamping device being provided at a second side of the transverse sliding base located at the right side of the central clamping device, wherein the second side of the transverse sliding base is located towards the central clamping device, each hollow shaft is provided with a moving bending head at the first end of each hollow shaft, for each hollow shaft, an end part of the moving bending head is cylindrical and is provided with a circle of a groove matched with the wire at a periphery of the end part of the moving bending head, each mandrel is detachably provided with a bending die at a first end of the mandrel, the bending die being provided with four cylindrical fixed bending modules arranged in two rows having connecting lines that are shaped in a rectangle, an interval between the two rows of fixed bending modules being matched with a diameter of the wire, and a second end of the mandrel is connected to a fixed die motor disposed on each longitudinal sliding base, a driven synchronous belt wheel is sleeved around a periphery of a second end of each hollow shaft, each longitudinal sliding base is provided with a moving die motor, an output shaft of the moving die motor being provided with a driving synchronous belt wheel matched with the driven synchronous belt wheel, and a synchronous belt sleeves the driven synchronous belt wheel and the driving synchronous belt wheel, the left clamping device includes a left base disposed on the respective longitudinal sliding base at the left side of the central clamping device, an upper surface of the longitudinal sliding base at the left side of the central clamping device being inclined relative to the left base, the upper surface of the left base being provided with a left sliding rail, the left sliding rail being provided with a left sliding base, the left sliding base of the left sliding rail being provided with a left mounting base, the left mounting base being provided with a clamping component driven by a clamping cylinder configured to open or clamp, and the left base is provided with a sliding cylinder driving the left sliding base of the left sliding rail to drive the clamping component to approach to the wire, the right clamping device includes a right base disposed on the respective longitudinal sliding base at the right side of the central clamping device, litheBan upper surface of the longitudinal sliding base at the right side of the central clamping device is inclined relative to the right base, the right base being provided with a right sliding rail, the right sliding rail being provided with a right sliding base, the right sliding base of the right sliding rail being provided with a right mounting base, the right mounting base being provided with a clamping component driven by a clamping cylinder configured to open or clamp, and the right base is provided with a sliding cylinder driving the right sliding base of the right sliding rail to drive the clamping component to approach to the wire, each of the longitudinal driving devices includes a longitudinal driving motor disposed on the respective one of the transverse sliding bases, each of the longitudinal sliding bases is provided with a longitudinal lead screw, and each longitudinal driving motor is connected to an end part of the longitudinal lead screw by a coupler.

2. The bending and molding mechanism according to claim 1, wherein:

each transverse driving device includes a rack disposed on the respective transverse sliding base, each of the transverse sliding bases is provided with a transverse driving motor, and an output shaft of each transverse driving motor extends outward from the respective transverse sliding base and each output shaft is connected to a gear matched with the rack.

* * * * *